US005249528A

United States Patent [19]

Lee

[11] Patent Number: 5,249,528

[45] Date of Patent: Oct. 5, 1993

[54] FIREWORKS SUPPORT KIT

[76] Inventor: Jervis R. Lee, 1038 Church Well Rd., Hattiesburg, Miss. 39401

[21] Appl. No.: 981,092

[22] Filed: Nov. 24, 1992

[51] Int. Cl.[5] ..... F42B 4/04

[52] U.S. Cl. ..... 102/361; 102/331; 124/29

[58] Field of Search ..... 102/331, 361; 124/26, 124/29

[56] References Cited

U.S. PATENT DOCUMENTS

| | | | |
|---|---|---|---|
| 1,922,081 | 8/1933 | Driggs, Jr. | 102/361 |
| 2,087,281 | 7/1937 | Fabrizio | 102/361 |
| 3,025,633 | 3/1962 | Kaye et al. | 102/361 |
| 3,385,163 | 5/1968 | Kotikov | 102/361 |
| 3,500,746 | 3/1970 | Ambrosini | 102/361 |
| 4,708,061 | 11/1987 | Buechel | 102/331 |
| 4,917,015 | 4/1990 | Lowery | 102/361 X |
| 5,187,323 | 2/1993 | Saxby | 124/73 |

*Primary Examiner*—Peter A. Nelson
*Attorney, Agent, or Firm*—Leon Gilden

[57] ABSTRACT

A kit construction includes a first organization to mount firecrackers and the like of an explosive nature, having a first tube reciprocatably mounting a second tube, with the first tube fixedly having an ejector rod coaxially directed to the first tube and the second tube to permit subsequent ejection of a firecracker subsequent to its detonation. The kit structure is further arranged to include a further support structure for mounting a rocket type firework thereto, with a third support structure arranged for mounting a fireworks member directing a showered array therefrom. A pivotal support holder is also provided for pivotally mounting and securing the first housing thereto to orient the first support housing relative to an underlying support.

3 Claims, 4 Drawing Sheets

FIREWORKS SUPPORT KIT

BACKGROUND OF THE INVENTION

1. Field of the Invention

The field of invention relates to fireworks support structure, and more particularly pertains to a new and improved fireworks support kit arranged for the provision to secure and position various firework workpieces.

2. Description of the Prior Art

Fireworks support structure of various types have been utilized in the prior art, wherein U.S. Pat. No. 4,917,015 to Lowery sets forth a fireworks rocket launch pad arranged for positioning and orienting a fireworks member.

U.S. Pat. No. 4,771,695 to Simpson sets forth a launching pad for fireworks to position and align the fireworks display relative to its projection and detonation.

The instant invention attempts to overcome deficiencies of the prior art by providing for a fireworks support kit arranged to manually accommodate various firework members and in this respect, the present invention substantially fulfills this need.

SUMMARY OF THE INVENTION

In view of the foregoing disadvantages inherent in the known types of fireworks support apparatus now present in the prior art, the present invention provides a fireworks support kit utilizing a plurality of support structure to position and align various firework members. As such, the general purpose of the present invention, which will be described subsequently in greater detail, is to provide a new and improved fireworks support kit which has all the advantages of the prior art fireworks support apparatus and none of the disadvantages.

To attain this, the present invention provides a kit construction including a first organization to mount firecrackers and the like of an explosive nature, having a first tube reciprocatably mounting a second tube, with the first tube fixedly having an ejector rod coaxially directed to the first tube and the second tube to permit subsequent ejection of a firecracker subsequent to its detonation. The kit structure is further arranged to include a further support structure for mounting a rocket type firework thereto, with a third support structure arranged for mounting a fireworks member directing a showered array therefrom. A pivotal support holder is also provided for pivotally mounting and securing the first housing thereto to orient the first support housing relative to an underlying support.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved fireworks support kit which has all the advantages of the prior art fireworks support apparatus and none of the disadvantages.

It is another object of the present invention to provide a new and improved fireworks support kit which may be easily and efficiently manufactured and marketed.

It is a further object of the present invention to provide a new and improved fireworks support kit which is of a durable and reliable construction.

An even further object of the present invention is to provide a new and improved fireworks support kit which is susceptible of a low cost of manufacture with regard to both materials and labor, and which accordingly is then susceptible of low prices of sale to the consuming public, thereby making such fireworks support economically available to the buying public.

Still yet another object of the present invention is to provide a new and improved fireworks support kit which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
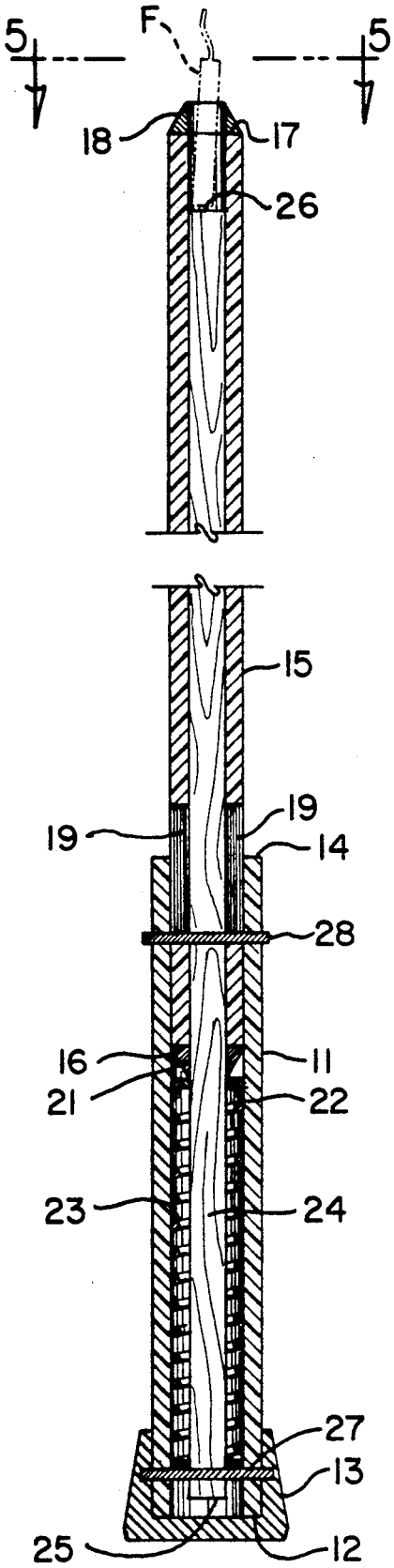
FIG. 1 is an orthographic cross-sectional illustration of the first support member of the invention.

With reference now to the drawings, and in particular to FIGS. 1 to 9 thereof, a new and improved fireworks support kit embodying the principles and concepts of the present invention and generally designated by the reference numerals 11 through 46 will be described.

Figure 2:
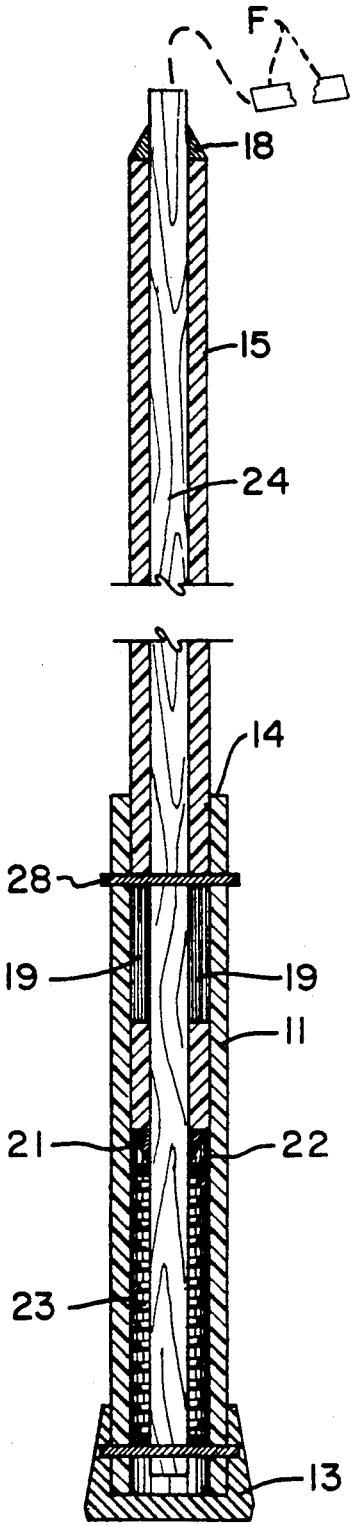
FIG. 2 is an orthographic cross-sectional illustration of the first support member in a second position ejecting a fireworks workpiece therefrom.
Figure 3:
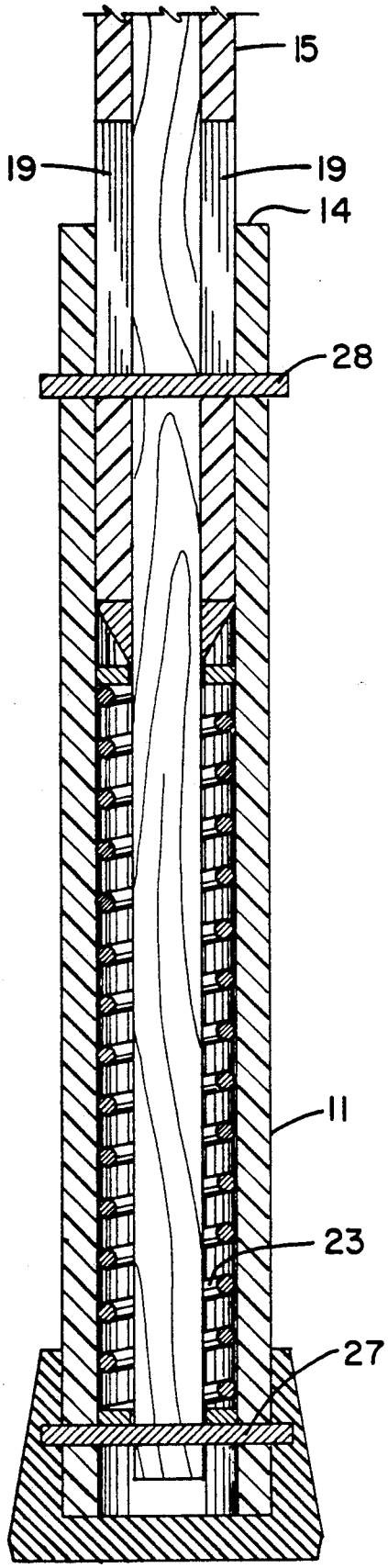
FIG. 3 is an enlarged orthographic cross-sectional illustration of the first housing mounting the second housing thereto.
Figure 4:
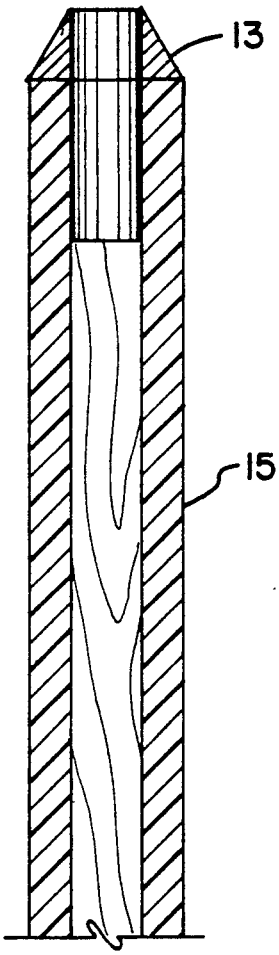
FIG. 4 is an enlarged orthographic cross-sectional illustration of the second housing and the ejector rod structure.
Figure 5:
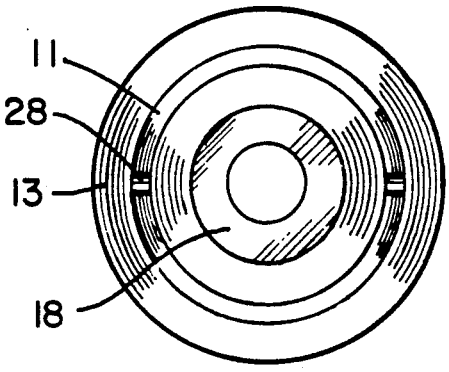
FIG. 5 is an orthographic view, taken along the lines 5—5 of FIG. 1 in the direction indicated by the arrows.

More specifically, the fireworks support kit of the invention essentially comprises a first rigid tubular housing 11 having a first housing first end 12 spaced from a first housing second end 14. A resilient cushion cup 13 is mounted to the first housing first end 12 to permit positioning of the first housing 11 against an individual's body in a non-slip convenient manner. A second rigid tubular housing 15 is telescopingly received within the first tubular housing 11 through the first housing first end 12 coaxially aligned with the first housing. The second housing 15 includes a second housing first end 16 spaced from a second housing second end 17, with the second housing second end 17 having a metallic second tubular member 18 fixedly mounted thereto coaxially aligned with the second tubular housing. A metallic first tubular member 21 is fixedly mounted to the second housing second end 17 for abutment with a metallic disc 22, that in turn captures a spring member 23 between the metallic disc 22 and an ejector rod mounting plate 27, to be described in more detail below, that in turn is directed through the resilient cushion cup 13 to secure the ejector rod 24, the resilient cushion cup 13, and the first tubular housing 11 together. The use of the metallic second tubular member 18 affords protection to the second tubular housing 15, and more specifically relative to the second tubular housing 15 second end 17. A plurality of parallel slots 19 are directed through the second tubular housing 15 in adjacency to the second housing first end 16, with a lock pin 28 directed through the first housing, the second housing, the slots 19, and the ejector rod 24 that is fixedly and coaxially mounted within the first and second housings. The ejector rod 24 is slidably received through the second housing 15, wherein when in a first position is positioned in a spaced relationship below the second housing second end 17 and in a second position, as indicated in FIG. 2, projects beyond the second housing second end, as well as the second tubular member 18.

Figure 6:
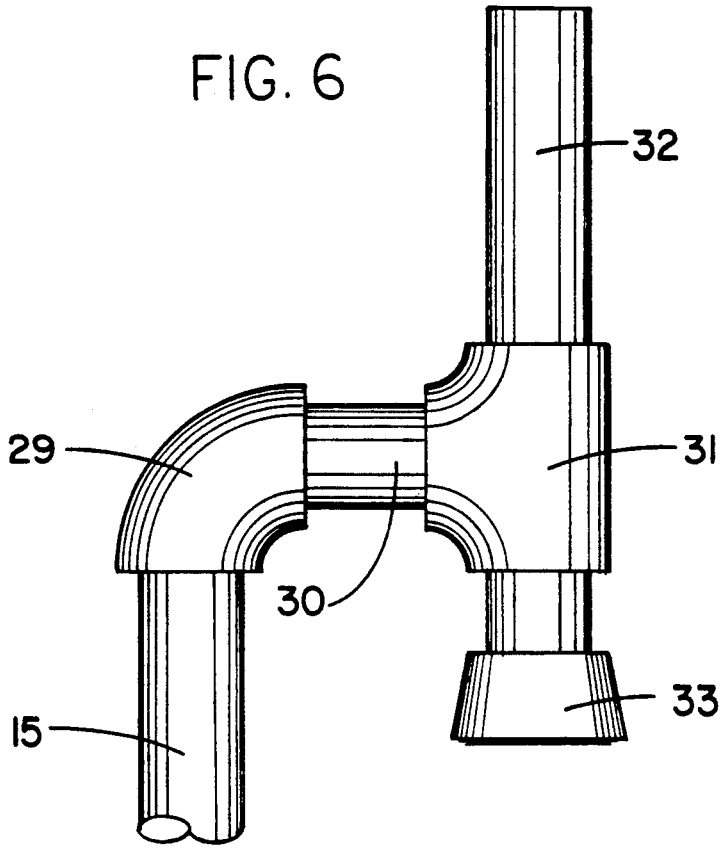
FIG. 6 is an orthographic view of a second support structure of the invention.

FIG. 6 indicates the kit having a second support structure to include a support elbow 29 receiving the second housing second end within a first end of the elbow, and the support elbow 29 having a connecting rod 30 directed through a second end of the elbow orthogonally orienting the connecting rod relative to the second support housing. A coupling housing 31 is provided orthogonally mounting a mounting tube 32 relative to the connecting rod 30. A second end of the mounting tube includes an end cap 33 removably mounted thereto permitting reception of a firework member, such as a rocket and the like, through a first end of the mounting tube 32.

Figure 7:
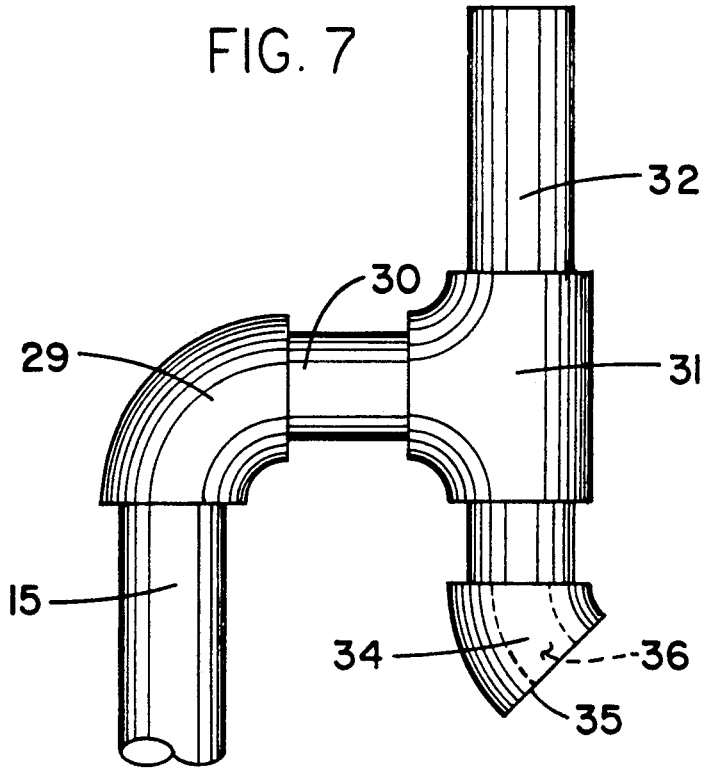
FIG. 7 is an orthographic view of the third support structure of the invention.

The FIG. 7 indicates the mounting tube 32 replaceably for positioning a directional elbow 34 relative to the first end of the mounting tube, with the directional elbow having outlet port 35 at an outermost end of the directional elbow conduit 36 directed through the directional elbow in communication with the mounting tube 32 to accommodate a fireworks display such as Roman candle and the like within the mounting tube permitting projection of a fireworks array through the directional elbow conduit 36 from within the mounting tube 32. The directional conduit 36 as indicated is canted away from the second housing 15.

Figure 8:
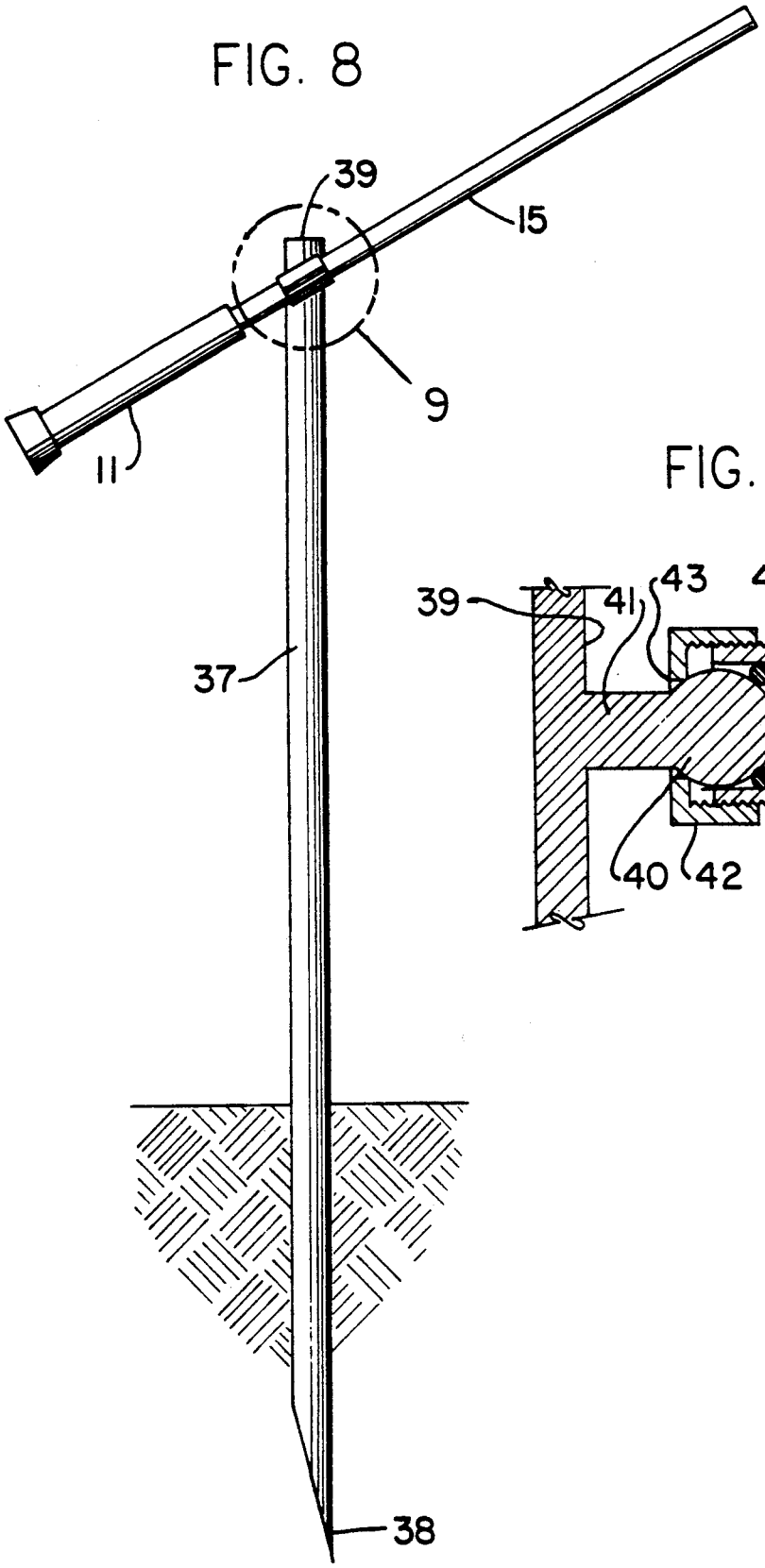
FIG. 8 is an orthographic view of a support rod structure pivotally mounting the first support structure of the invention.
Figure 9:
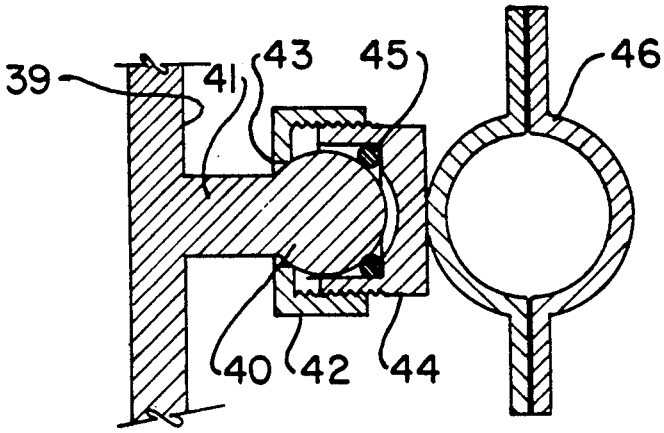
FIG. 9 is an enlarged cross-sectional illustration of section 9 as set forth in FIG. 8.

The FIG. 8 indicates the use of a support rod 37, having a support rod pointed first end 38 for projection within the ground surface, with the support rod second end 39 mounting a spherical member 40 in adjacency thereto, with the spherical member 40 having a spherical member positioning rod 41 fixedly mounted to the support rod 37. The spherical member includes a first cap 42 positioned between the spherical member and the support rod, having a first cap bore 43 receiving the positioning rod 41 therethrough. A second cap 44 is threadedly received within the first cap, with the second cap having a sealing ring 35 to frictionally engage and permit angular orientation of the first and second caps relative to the spherical member 40. The second cap 44 includes a second cap clamp 46 mounted thereto to frictionally receive the second housing 15 therethrough to permit orientation of the second housing as desired.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A fireworks support kit, comprising, a first support structure, having a first rigid tubular housing, having a first housing first end and a first housing second end, the first housing first end including a resilient cushion cup fixedly mounted to the first housing first end, and the first housing second end including a second rigid tubular housing telescopingly received therethrough coaxially aligned with the first tubular housing, the second tubular housing having a second housing second end and a second housing first end, with the second housing second end including a rigid metallic first tubular member secured thereto, and a spring member interposed between the first tubular member and the resilient cushion cup, with a mounting plate directed through the cushion cup, the first tubular housing, and an ejector rod coaxially directed through the first tubular housing and extending into the second tubular housing, with the ejector rod spaced from the second tubular housing second end in a first position, and projecting beyond the second tubular housing second end in a second position, and the second tubular housing having a plurality of parallel slots directed through the second tubular housing in adjacency to the second tubular housing first end, with a lock pin directed through the slots, the first tubular housing, and the ejector rod for rigid alignment of the ejector rod within the second tubular housing.

2. A fireworks support kit as set forth in claim 1 further including a second support structure, with the second support structure having a support elbow, the support elbow receiving the second housing second end therewithin, and the support elbow further including a connecting rod, wherein the connecting rod is orthogonally oriented relative to the second tubular housing positioned within the support elbow, and a coupling housing fixedly mounted to the connecting rod spaced from the support elbow, with the coupling housing including a mounting tube directed therethrough orthogonally oriented relative to the connecting rod, with the mounting tube having a mounting tube first end, with the mounting tube first end having a mounting tube end cap removably mounted relative to the mounting tube first end, and a directional elbow arranged for securement to the mounting tube second end spaced from the mounting tube first end upon removal of the mounting tube end cap, wherein the directional elbow includes an outlet port canted away from the second housing when positioned within the support elbow.

3. A fireworks support kit as set forth in claim 2 further including a support rod having a support rod first pointed end and a support rod second end, wherein the support rod second end includes a spherical member positioning rod fixedly mounted to the support rod in adjacency to the support rod second end, with the spherical member mounted to the spherical member positioning rod, with a first cap having a first cap bore, with the spherical member positioning rod directed therethrough, and the first cap threadedly receiving a second cap, wherein the first cap and the second cap enclose the spherical member in surrounding relationship, with the second cap having a second cap sealing ring, and the second cap threadedly received within the first cap for selective securement of the first cap and the second cap relative to the spherical member, and the second cap having a second cap clamp, with the second cap clamp arranged for receiving the second tubular housing therethrough.

* * * * *